US007827626B2

(12) United States Patent
Zhou

(10) Patent No.: US 7,827,626 B2
(45) Date of Patent: Nov. 9, 2010

(54) HINGE FOR TOILET SEAT

(76) Inventor: Wenhui Zhou, Da Che Industrial Area, Nanlang Town, Zhongshang City, Guangdong Province, 528451 (CN)

( * ) Notice: Subject to any disclaimer, the term of this patent is extended or adjusted under 35 U.S.C. 154(b) by 617 days.

(21) Appl. No.: 11/824,102

(22) Filed: Jun. 29, 2007

(65) Prior Publication Data

US 2009/0000017 A1 Jan. 1, 2009

(51) Int. Cl.
*A47K 13/12* (2006.01)

(52) U.S. Cl. ..... 4/236; 4/237; 4/240

(58) Field of Classification Search ..... 4/234–240
See application file for complete search history.

(56) References Cited

U.S. PATENT DOCUMENTS 3,550,164 A * 12/1970 Pease ..... 4/236
3,916,756 A * 11/1975 Yoda ..... 24/682.1
4,326,307 A * 4/1982 Baillie et al. ..... 4/236
6,070,295 A * 6/2000 Hulsebus ..... 16/254
7,203,975 B2 * 4/2007 Vierkant, III ..... 4/240
7,281,276 B2 * 10/2007 Vierkant et al. ..... 4/240
7,389,549 B2 * 6/2008 Vierkant, III ..... 4/236

* cited by examiner

*Primary Examiner*—Khoa D Huynh
(74) *Attorney, Agent, or Firm*—Raymond Y. Chan; David and Raymond Patent Firm

(57) ABSTRACT

A toilet seat includes a toilet bowl and a toilet platform. A toilet platform includes a bowl seat having a seating portion and a mounting portion. A seat hinge mechanism includes two spaced apart retention bases adapted for securely mounting at the toilet platform of the toilet bowl wherein the joint members are detachably engaged with the retention bases respectively for detachably mounting bowl seat on the toilet platform of the toilet bowl in a tool-less manner.

1 Claim, 5 Drawing Sheets

HINGE FOR TOILET SEAT

BACKGROUND OF THE PRESENT INVENTION

1. Field of Invention

The present invention relates to a toilet facility, and more particularly to the hinge for toilet seat which is capable of easily mounting and demounting a toilet covering in a tool-less manner for cleaning and replacement goals.

2. Description of Related Arts

As time goes by, more and more designs for hygiene device create by different inventors. For example, an automatic flush system, an automatic warming system in toilet seat, and so on. So it is very common for people to use different hygiene devices in the restroom. However, the toilet seat, according to the above patents, has several common drawbacks.

If we want to clean the toilet seat well, all we need to do is to detach the toilet seat. Whatever assembling and disassembling the toilet seat covering, it not only needs complicated steps to unscrew the nuts in the limited space, but also sometimes the seat is too heavy so that it is not easy for us to move. Moreover, in some cases, the nuts may be hard to detach because the nuts might be fixed by glue. Furthermore, when exposing to the moisture for a long time, the meshing engagement with the hinge being shaft rusted and corroded easily. To sum up, time consuming and inconvenient obstruct the way we disassembling the toilet seat for cleaning and replacing.

SUMMARY OF THE PRESENT INVENTION

A main object of the present invention is to provide a hinge for toilet seat, wherein the advanced toilet covering hinge is capable of easily assembling and disassembling so as to eliminate the time and steps in a tool-less manner for cleaning and replacement goals.

Another object of the present invention is to provide a hinge for toilet seat, wherein the material of the advanced toilet covering hinge is light and solid. Therefore, the user is able to mechanically-manually operate the toilet seat for a long time. Even though the surrounding in the bathroom is very humid, the good quality of the material can support the user for constantly using away from rusted and corroded.

Another object of the present invention is to provide a hinge for toilet seat, wherein a covering cap can be replaced individually. Therefore, if the covering cap doesn't work or need to clean, any individual is able to simply replace the covering cap by hand, so as to reduce the cost and time we need.

Another object of the present invention is to provide a hinge for toilet seat, wherein the advanced toilet covering hinge which is reliable and that can be easily mounted and maintained.

Accordingly, to achieve above mentioned objects, the present invention provide a toilet seat for detachably mounting to a toilet bowl having a toilet platform, comprising:

a bowl seat having a seating portion and a mounting portion; and a seat hinge mechanism comprising two spaced apart retention bases adapted for securely mounting at the toilet platform of said toilet bowl, and two spaced apart joint members provided at the mounting portion of the bowl seat, wherein the joint members are detachably engaged with the retention bases respectively for detachably mounting bowl seat on the toilet platform of the toilet bowl in a tool-less manner.

These and other objectives, features, and advantages of the present invention will become apparent from the following detailed description, the accompanying drawings, and the appended claims.

DETAILED DESCRIPTION OF THE PREFERRED EMBODIMENT

Figure 1:
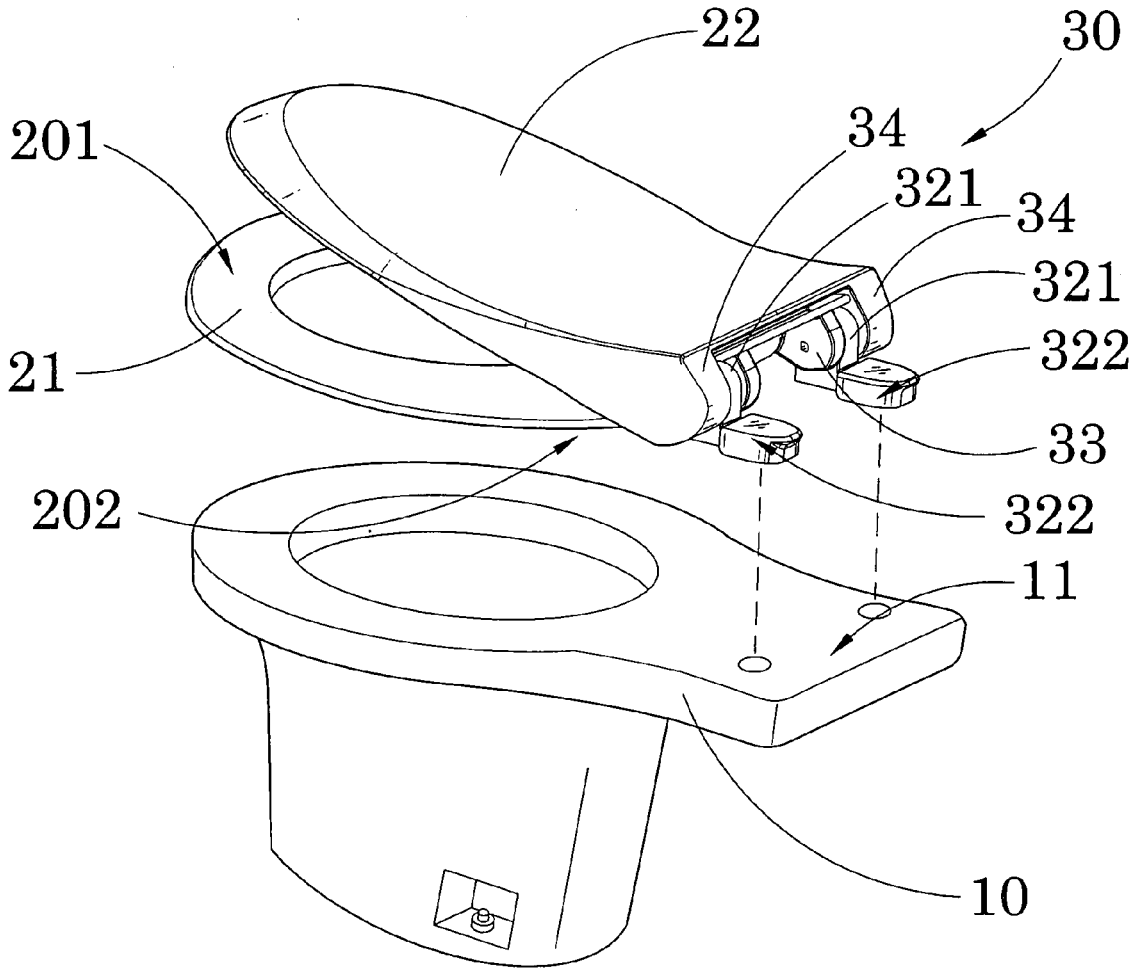
FIG. 1 is a schematic diagram of toilet seat for mounting on a toilet bowl according to a preferred embodiment of the present invention.
Figure 2:
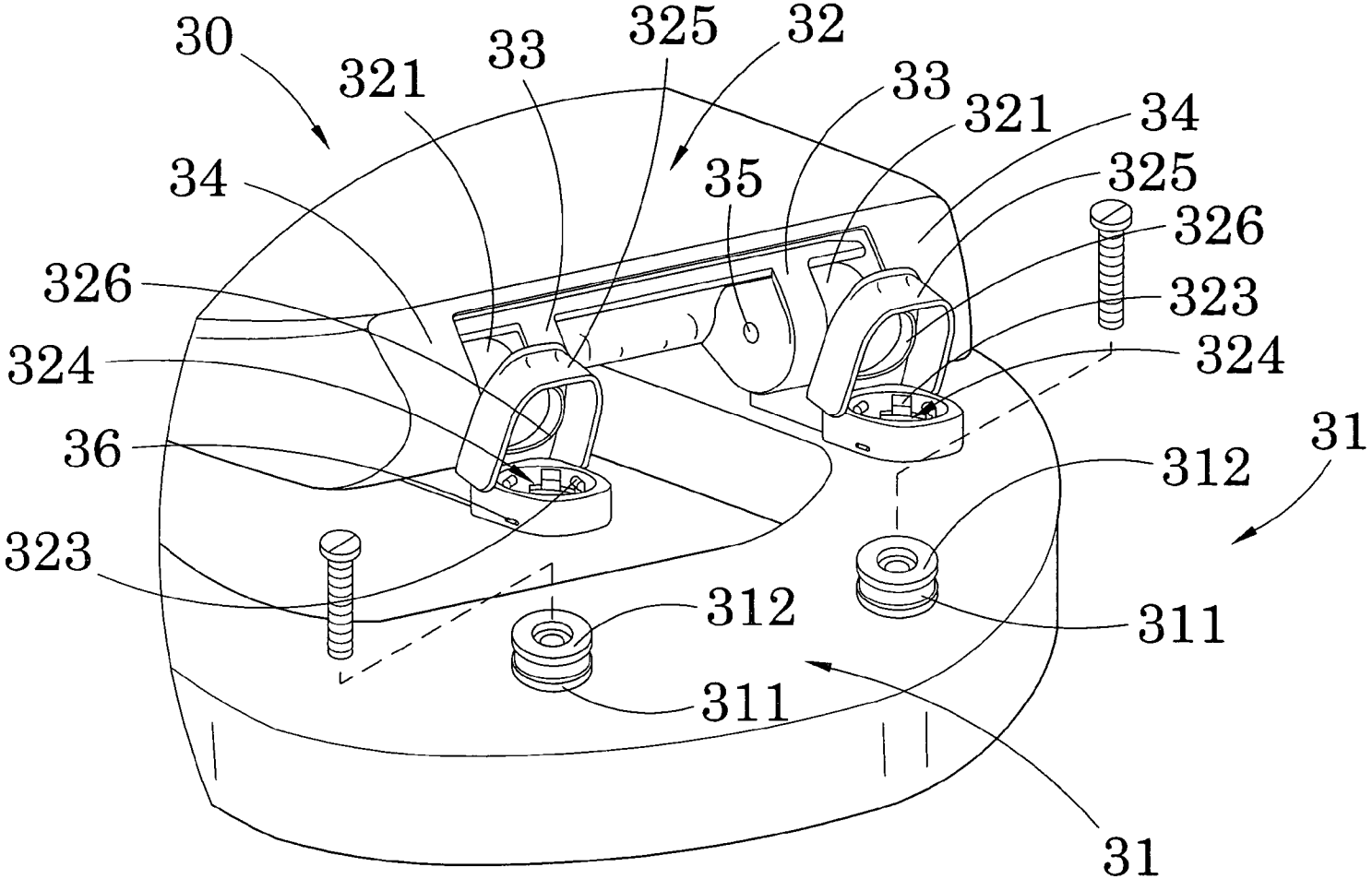
FIG. 2 is a rear perspective view of seat hinge mechanism of the toilet seat in open position according to the above preferred embodiment of the present invention.
Figure 5:
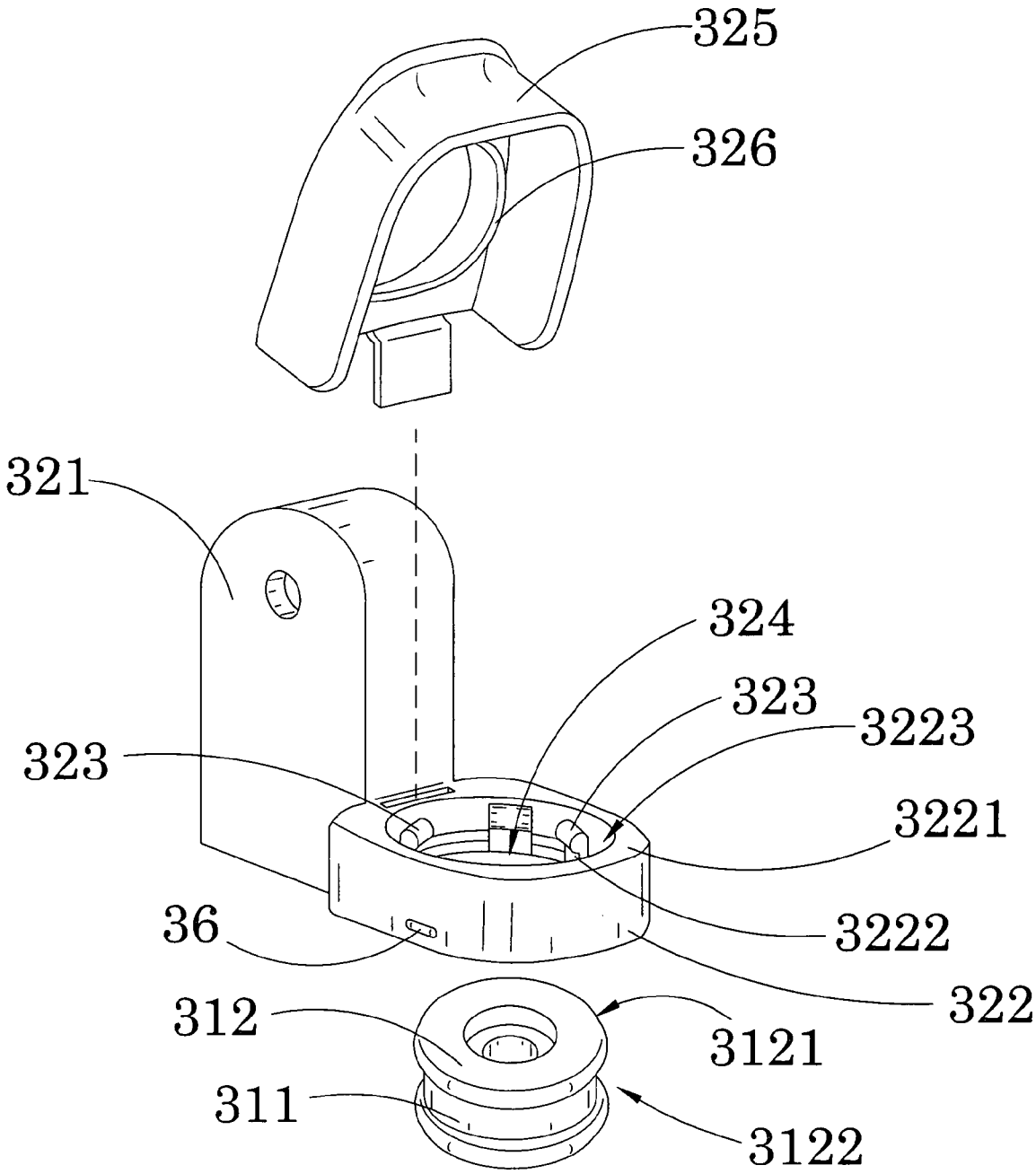
FIG. 5 is a perspective view of the seat hinge mechanism according to the above preferred embodiment of the present invention.

Referring to FIG. 1, FIG. 2 and FIG. 5 of the drawing, a toilet seat according to a preferred embodiment of present invention is illustrated, wherein the toilet seat, which is adapted for detachably mounting at a toilet bowl 10 having a toilet platform 11, comprises a bowl seat 20 having a seating portion 201 and a mounting portion 202 and a seat hinge mechanism 30 for detachably mounting the bowl seat 20 at a toilet bowl 10.

The seat hinge mechanism 30 comprises two spaced apart retention bases 31 adapted for securely mounting at the toilet platform 11 of the toilet bowl 10 and two spaced apart joint members 32 provided at the mounting portion 202 of the bowl seat 20, wherein the joint members 32 are detachably engaged with the retention bases 31 respectively for detachably mounting bowl seat 20 on the toilet platform 11 of the toilet bowl 10 in a tool-less manner.

Accordingly, the seat hinge mechanism 30 of the present invention is made of light weight but durable material such as plastic. In addition, the seat hinge mechanism 30 is made of waterproof material such that when the toilet seat of the present invention is detached from the toilet bowl 10, the entire toilet seat is adapted to be cleaned by water.

According to the preferred embodiment, each of the joint members 32 comprises a pivot body 321 pivotally mounting to the mounting portion of the bowl seat 20 and base body 322. The base body 322 is integrally extended from the pivot body 321 and is detachably coupled the respective retention base 31, such that when the base bodies 322 are coupled with the retention bases 31 respectively, the bowl seat 20 is pivotally and selectively folded on top of the toilet platform 11 of the toilet bowl 10. Since the pivot body 321 is integrally extended from the base body 322, each of the joint members 32 is formed as a one piece structure to enhance the strength thereof to pivotally connect the bowl seat 20 with the toilet bowl 10. In other words, the seat hinge mechanism 30 is durable enough that the seat hinge mechanism 30 is reliable and can be easily mounted and maintained for such detachably mounting manner.

Figure 3:
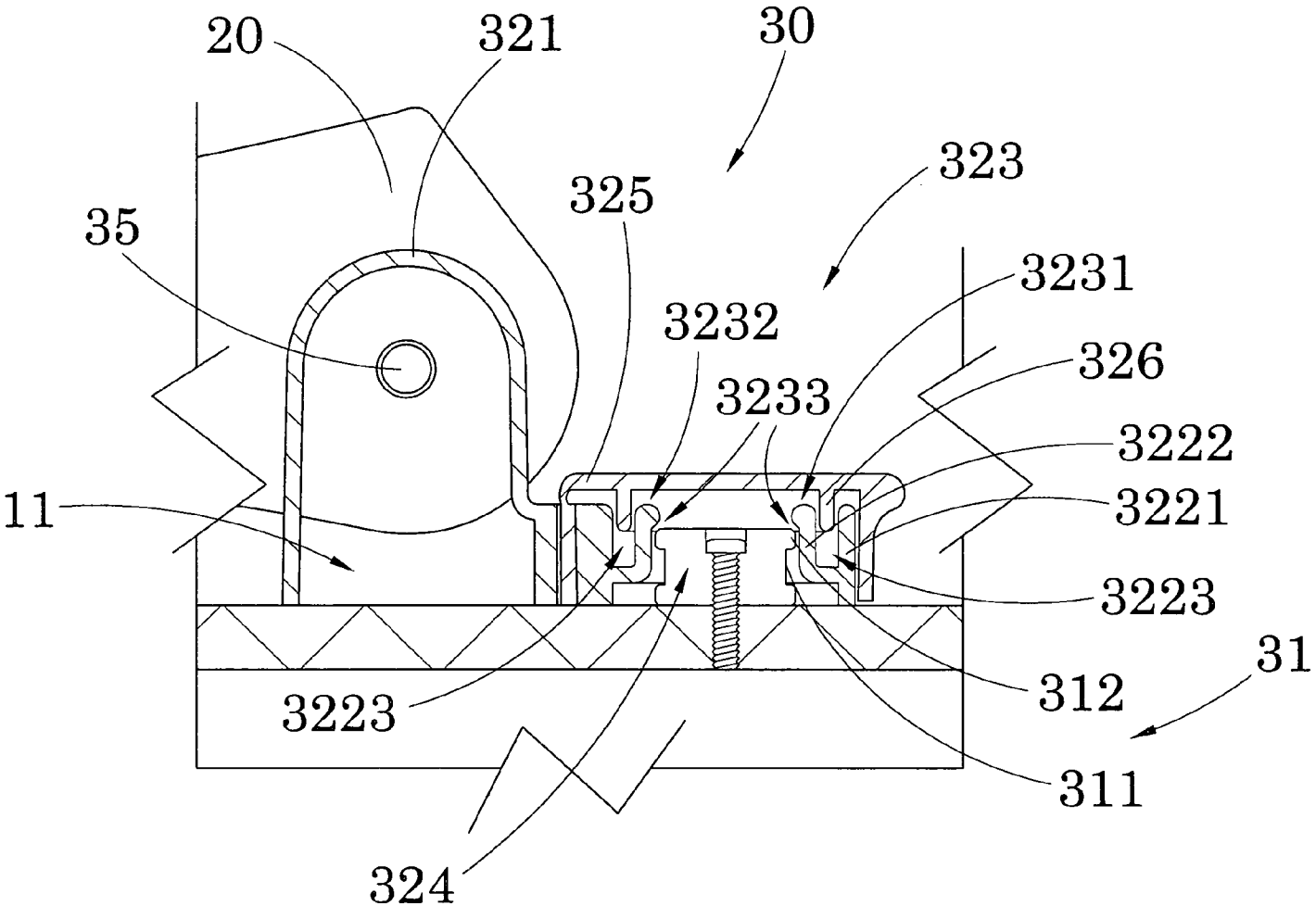
FIG. 3 is a sectional view of the seat hinge mechanism in closed position according to the above preferred embodiment of the present invention.

As shown in FIG. 3, each of the joint members 32 comprises a plurality of resilient arms 323 spacedly extending to define a locking cavity 324 therebetween and to detachably engage with the respective retention base 31 such that each of resilient arms 323 provides an urging force against the retention base 31 when the joint member 32 is mounted to the retention base 31 to retain the bowl seat 20 in position. It is worth to mention that the resilient arms 323 are of resilience. When each of the respective retention base 31 slides into the locking cavity 324, the upper part of the resilient arms 323 will smoothly head back for matching the size of the retention base 31 such that we can make sure both of them will fix very well.

The retention base 31 further comprises an elongated shaft body 311 and an enlarged head body 312 which is integrally and upwardly extended from the shaft body 311 and is arranged in such a manner that when the joint member 32 is coupled with the retention base 31, the head body 312 is slidably passed through the locking cavity 324 until the resilient arms 323 are engaged with the shaft body 311 to releasably lock up the joint member 32 with the retention base 31.

Accordingly, each of the resilient arms 323 has an enlarged engaging end 3231 defining an upper slanted guiding surface 3232 and a lower slanted guiding surface 3233, wherein when each of the retention bases 31 is engaged with the respective joint member 32, the head body 312 of each of the retention bases 31 is guided to slide at the lower slanted guiding surfaces 3233 to slightly and outwardly bend the resilient arms 323 until the engaging ends 3231 of the resilient arms 323 engage with the shaft body 311 such that the head body 312 is slid through the locking cavity 324, and when each of the retention bases 31 is disengaged with the respective joint member 32, the head body 312 is guided to slide at the upper guiding surfaces 3232 to slightly and outwardly bend the resilient arms 323 to allow the head body 312 of each of the retention bases 31 being slid out of the locking cavity 324.

In order to enhance the sliding movement of each of the retention bases 31 within the respective locking cavity 324, the head body 312 of each of the retention bases 31 further has an upper curved surface 3121 and a lower curved surface 3122, as shown in FIG. 5. When each of the retention bases 31 is engaged with the respective joint member 32, the upper curved surface 3121 of the head body 312 is slidably engaged with the lower slanted guiding surfaces 3233 of the resilient arms 323 until the engaging ends 3231 of the resilient arms 323 engage with the shaft body 311. When each of the retention bases 31 is disengaged with the respective joint member 32, the lower curved surface 3122 of the head body 312 is slidably engaged with the upper guiding surfaces 3232 of the resilient arms 323 to allow the head body 312 of each of the retention bases 31 being slid out of the locking cavity 324.

The base body 32 further comprises an outer surrounding wall 3221 and an inner wall 3222 defining an adjustment cavity 3223 therebetween, wherein the resilient arms 323 are integrally formed at the inner wall 3222 that each of the resilient arms 323 is adapted to slightly bend towards the adjustment cavity 3223 to adjust a size of the locking cavity 324 so as to apply the urging force against the retention base 31. It is worth to mention that the space of the adjustment cavity 3223 is important that without the adjustment cavity 32 the respective retention base 3123, the retention base 31 can't slide in the locking cavity 324. In other words, the adjustment cavity 3223 provides enough clearance for each of the resilient arms 323 to be slightly and outwardly bent so as to engage with the respective retention bases 31.

Figure 4:
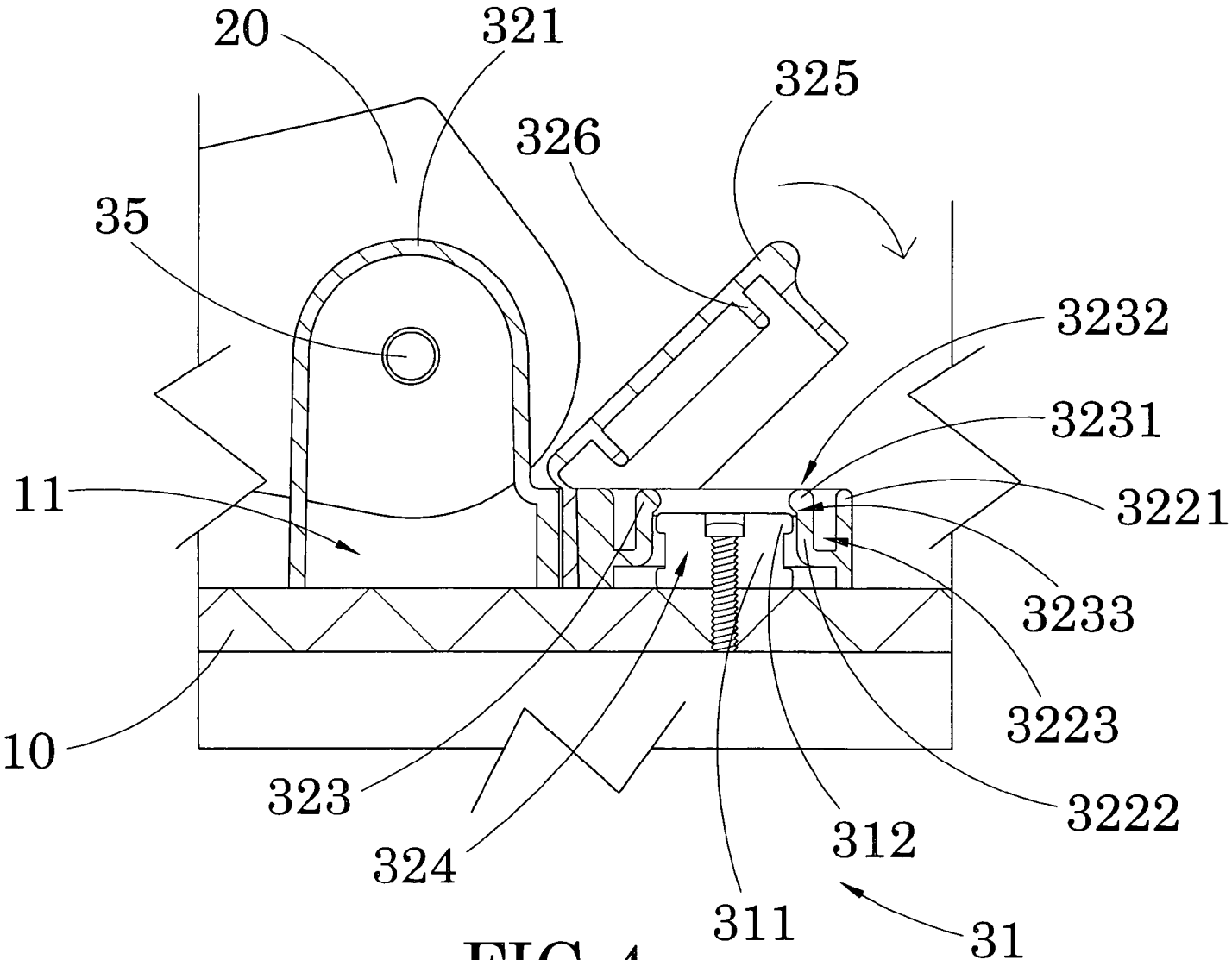
FIG. 4 is a sectional view of the seat hinge mechanism in opened position according to the above preferred embodiment of the present invention.

As shown in FIG. 4 and FIG. 5, each of the joint members 32 further comprises a locking cap 325 pivotally coupling with the base body 322 to enclose the locking cavity 324 and a locking wall 326 through cap locker 327 which is integrally extended from the locking cap 325 and is arranged in such a manner that when the locking cap 325 is pivotally folded to enclose the locking cavity 324, the locking wall 326 is slid into the adjustment cavity 3223 to restrict a movement of each of the resilient arms 323 so as to prevent the retention bases 31 from being disengaged with the joint members 32. When the locking cap 325 is closed, it will totally cover the base body 322 to prevent fluid or dust entering thereinto. The locking cap 325 further comprises a living hinge 325'. An integrally formed slot 321' is located between the pivot body 321 and the base body 322. The living hinge 325' extends into the slot 321' for pivotal movements of the locking cap 325.

The bowl seat 20 further comprises a seat panel 21 defining the seating portion 201 thereon and a seat cover 22 pivotally connecting to the seat panel 21 via the seat hinge mechanism 30 such that the seat panel 21 and the seat cover 22 are selectively and pivotally folded with respect to the toilet platform 11 of the toilet bowl 10. Furthermore, the seat hinge mechanism 30 further comprises two panel joints 33 spacedly and integrally extended from the seat panel 21 and two cover joints 34 spacedly and integrally extended from the seat cover 22 to couple with the panel joints 33 respectively, wherein the pivot body 321 of each of the joint members 32 is mounted between the panel joint 33 and the cover joint 34 via a pivot axle 35. Two or more cap lockers 36 are integrally formed at two outer sides of each of the base bodies 322 to detachably lock the locking cap 325 at the closed position so as to retain the locking cap 325 in a covering position.

In order to mount the toilet seat of the present invention on the toilet bowl 10, the user is able to align the locking cavities 324 with the retention bases 31 respectively. Then, the user is able to apply a downward pushing force to slidably insert the retention bases 31 into the locking cavities 324 until the resilient arms 323 are engaged with the shaft bodies 311 to lock up the joint members 32 with the retention bases 31. The user is able to cover the locking cap 325 to enclose the locking cavity 324, such that the locking wall 326 is slid into the adjustment cavity 3223 to restrict a movement of each of the resilient arms 323 so as to prevent the retention bases 31 from being disengaged with the joint members 32. In order to detach the toilet seat of the present invention from the toilet bowl 10, the user may simply open the locking cap 325 and apply an upward pulling force to slidably disengage the retention bases 31 with the locking cavities 324. Therefore, the user is able to clean the toilet seat of the present invention after the toilet seat of the present invention is detached.

It is worth to mention that the material of the hinge for toilet seat is light and solid. Therefore, the user is able to mechanically-manually operate the toilet seat for a long time. Even though the surrounding in the bathroom is very humid, the good quality of the material can support the user for constantly using away from rusted and corroded.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A toilet seat for detachably mounting on a toilet bowl having a toilet platform; comprising:

a bowl seat having a seating portion and a mounting portion; and a seat hinge mechanism, comprising:

two spaced apart retention bases adapted for securely mounting at said toilet platform of said toilet bowl; and two spaced apart joint members provided at said mounting portion of said bowl seat, wherein said joint members are detachably engaged with said retention bases respectively for detachably mounting bowl seat on said toilet platform of said toilet bowl in a tool-less manner, wherein each of said joint members comprises a pivot body pivotally mounting to said mounting portion of said bowl seat and base body which is integrally extended from said pivot body and is detachably coupled said respective retention base, such that when said base bodies are coupled with said retention bases respectively, said bowl seat is pivotally and selectively folded on top of said toilet platform of said toilet bowl, wherein each of said joint members further comprises a plurality of resilient arms spacedly extending to define a locking cavity therebetween and to detachably engage with said respective retention base such that each of resilient arms provides an urging force against said retention base when said joint member is mounted to said retention base to retain said bowl seat in position, wherein each of said retention bases comprises an elongated shaft body and an enlarged head body which is integrally and upwardly extended from said shaft body and is arranged in such a manner that when said joint member is coupled with said retention base, said head body is slidably passed through said locking cavity until said resilient arms are engaged with said shaft body to releasably lock up said joint member with said retention base, wherein each of said resilient arms has an enlarged engaging end defining an upper slanted guiding surface and a lower slanted guiding surface, wherein when each of said retention bases is engaged with said respective joint member, said head body of each of said retention bases is guided to slide at said lower slanted guiding surfaces to slightly and outwardly bend said resilient arms until said engaging ends of said resilient arms engage with said shaft body such that said head body is slid through said locking cavity, and when each of said retention bases is disengaged with said respective joint member, said head body is guided to slide at said upper guiding surfaces to slightly and outwardly bend said resilient arms to allow said head body of each of said retention bases being slid out of said locking cavity, wherein said base body comprises an outer surrounding wall and an inner wall defining an adjustment cavity therebetween, wherein said resilient arms are integrally formed at said inner wall that each of said resilient arms is adapted to slightly bend towards said adjustment cavity to adjust a size of said locking cavity so as to apply said urging force against said retention base, wherein each of said joint members further comprises a locking cap pivotally coupling with said base body to enclose said locking cavity and a locking wall which is integrally extended from said locking cap and is arranged in such a manner that when said locking cap is pivotally folded to enclose said locking cavity, said locking wall is slid into said adjustment cavity to restrict a movement of each of said resilient arms so as to prevent said retention bases from being disengaged with said joint members, wherein said locking further comprises a living hinge which extends into a integrally formed slot locating between said pivot body and said base body, said living hinge allows pivotal movements of said locking cap, wherein said bowl seat comprises a seat panel defining said seating portion thereon and a seat cover pivotally connecting to said seat panel via said seat hinge mechanism such that said seat panel and said seat cover are selectively and pivotally folded with respect to said toilet platform of said toilet bowl, wherein said seat hinge mechanism further comprises two panel joints spacedly and integrally extended from said seat panel and two cover joints spacedly and integrally extended from said seat cover to couple with said panel joints respectively, wherein said pivot body of each of said joint members is mounted between said panel joint and said cover joint via a pivot axle.

* * * * *